US006216855B1

(12) United States Patent
Gröne

(10) Patent No.: US 6,216,855 B1
(45) Date of Patent: Apr. 17, 2001

(54) TRAY FOR CONTAINING FOODSTUFFS AND LUXURY FOODS WHICH GIVE OFF LIQUIDS

(75) Inventor: Horst-Ditmar Gröne, Schwanewede (DE)

(73) Assignee: Linpac Plastics Limited (GB)

( * ) Notice: Subject to any disclaimer, the term of this patent is extended or adjusted under 35 U.S.C. 154(b) by 0 days.

(21) Appl. No.: 09/269,049

(22) PCT Filed: Sep. 9, 1997

(86) PCT No.: PCT/EP97/04920

§ 371 Date: Jun. 7, 1999

§ 102(e) Date: Jun. 7, 1999

(87) PCT Pub. No.: WO98/12126

PCT Pub. Date: Mar. 26, 1998

(30) Foreign Application Priority Data

Sep. 19, 1996 (DE) ..... 196 38 239

(51) Int. Cl.[7] ..... B65D 81/26

(52) U.S. Cl. ..... 206/204; 206/562; 426/124; 426/127

(58) Field of Search ..... 206/562, 204; 426/105, 127, 124, 129, 410; 428/36.5

(56) References Cited

U.S. PATENT DOCUMENTS

| | | | | |
|---|---|---|---|---|
| 3,834,606 | * | 9/1974 | Andersson | 206/204 |
| 4,042,746 | * | 8/1977 | Hofer | 428/311 |
| 4,275,811 | * | 6/1981 | Miller | 206/204 |
| 4,702,377 | * | 10/1987 | Grone | 206/557 |

FOREIGN PATENT DOCUMENTS

| | | |
|---|---|---|
| 327 783 | 2/1976 | (AT) . |
| 462 490 | 10/1973 | (AU) . |
| 62 881 | 2/1968 | (DE) . |
| 2 341 890 | 3/1974 | (DE) . |
| 40 39 354 | 6/1992 | (DE) . |
| 92 06 407 U | 8/1992 | (DE) . |
| 43 13 334 | 9/1994 | (DE) . |
| 44 23 283 | 1/1996 | (DE) . |
| 0 182 139 | 5/1986 | (EP) . |
| 0 520 509 | 12/1992 | (EP) . |
| 2 702 192 | 9/1994 | (FR) . |
| WO 96/01218 | 1/1996 | (WO) . |
| 97 10161 | 3/1997 | (WO) . |

* cited by examiner

*Primary Examiner*—Paul T. Sewell
*Assistant Examiner*—Shian Luong
(74) *Attorney, Agent, or Firm*—Technoprop Colton LLC

(57) ABSTRACT

Trays are known with two waterproof plastic plies, between which an absorbent paper insert is located, the upper ply (12) having openings (14) for passage of liquid. Re-use of these trays requires separation of the insert from the other plies. According to the invention, the insert (13) also consists of a plastic, i.e. of an open-cell foam plastic. All three plies (11, 12, 13) are compressed together in the area of a surrounding rim (21) so that the insert (13) is no longer open-celled or absorbent in this area.

13 Claims, 4 Drawing Sheets

TRAY FOR CONTAINING FOODSTUFFS AND LUXURY FOODS WHICH GIVE OFF LIQUIDS

Figure 1:
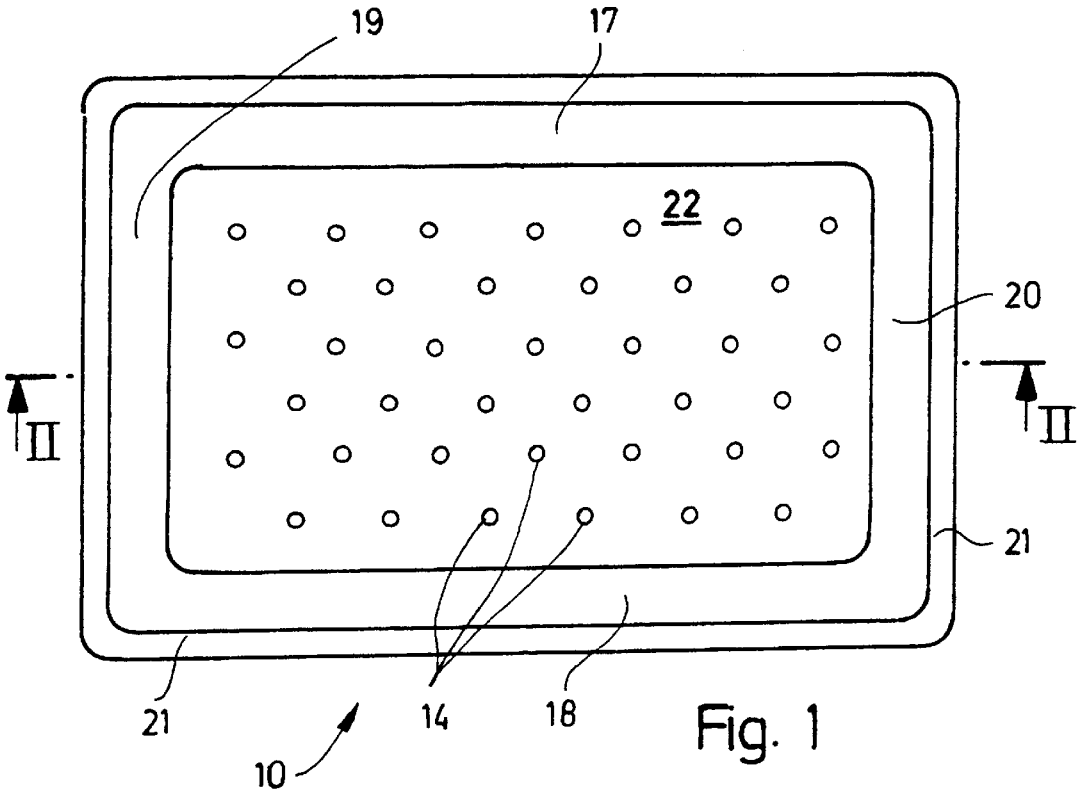

The invention relates to a tray for containing foodstuffs and luxury foods giving off liquids, particularly meat, fish or poultry, with a basic tray member having a base, side walls and transverse side walls, and which has at least two outer plies of waterproof plastic and an absorbent layer located between the plies, openings being provided in the upper ply facing the foodstuffs and luxury foods, for passage of the liquid into the absorbent layer.

Previous trays of the type named have an absorbent layer of paper, cellulose or the like. Re-use of such a tray, consisting for example of plastics, in the sense of a closed circuit, is difficult, as the layer (not consisting of plastic) must firstly be separated in a complex process.

On this basis it is the object of the present invention to provide a tray which may be simply re-used and nevertheless has a good capacity for absorbing liquid.

The purpose is achieved according to the invention in that the absorbent layer consists of an open-celled plastic preferably of an open-celled foam plastic. In contrast to other plies, this layer is not waterproof and thus absorbs the separated liquid into its open cells. Separation of the individual plies or of the layer in this construction is no longer necessary for re-use of old materials, as the outer plies and the absorbent layer consist entirely of plastic.

More advantageously, the lower ply consists of a closed-cell foam plastic, whilst the upper ply is produced from a compact, i.e. non-foamed plastic, particularly from a sheet. The closed-cell foam plastic is soft, pleasant to handle, has a high heat insulating effect and is waterproof. The upper compact ply has a relatively smooth surface and thus is pleasant in appearance. In the non-visible (lined) construction, the central absorbent layer is hidden from view, as are the liquids which have penetrated the absorbent layer, for example reddish meat juice. The upper compact ply can optionally be either coloured or uncoloured. Alternatively it may also be envisaged to associate with the outer side of the lower ply a further lowermost ply of compact plastics, particularly a sheet. The tray is then constructed in four plies or four layers. This additional lowermost ply can correspond to the upper ply, i.e. can be either coloured or uncoloured.

It is particularly advantageous if, in addition to the formation of the lower ply from closed-cell foam plastic, the (central) absorbent layer consists of open-cell foam plastic. The material involved here is totally open-celled, e.g. foam plastic. Correspondingly, the lower ply is formed from entirely closed-celled, e.g. foam plastic. In this way there is a separation of the tray which complies with requirements. This separation is also advantageous because the layer and the ply may be particularly easily formed either from entirely open-cell or closed-cell foam plastic. In this connection, entirely open-cell foam plastic or entirely closed-cell foam plastic means that, during manufacture of the corresponding layer or ply, an attempt is made to obtain either as many closed or as many open-cells as possible. In the ideal case all, i.e. 100% of the cells would either be open or closed. This ideal case however is not always achieved in practice, so that the absorbent layer, made of open-cell foam plastic, contains open cells to a small degree, and the lower ply made of closed-cell foam plastic, contains open cells to a small degree. As a rule, in the case of closed-cell foam plastics, at least 90% of the cells are closed, while with open-cell foam plastics at least 90% of the cells are open.

Accordingly, when entirely closed cells are mentioned, this is to be taken to mean a foam plastic in which as many cells as possible are closed, but also a small proportion of the cells can be open. Conversely, in the case of an open-cell foam plastic, the majority of the cells are open, while a small proportion of the cells can be closed.

The invention further relates to a surrounding edge of the tray. The two plies are compressed together with the absorbent layer in the area of the surrounding edge, in such a way that the layer is no longer open-celled in this lateral area. For this purpose, the layer in the area of the surrounding edge of the tray is preferably partly compacted. The lateral area of the layer is rendered non-cellular by means of the compression procedure. Thus the absorbed liquid cannot pass out over the edge. In addition, the lateral compression is only carried out to such a degree that the lower ply in the lateral area does in fact lose strength, but remains flexible and thus is not compacted.

In this way sharp edges in the area of the surrounding rim are avoided. According to an advantageous further development of the invention, the base wall of the tray is at least partly curved in configuration. This curvature is of such type that at least the inner wall of the tray, upon which the articles to be contained by the tray rest, has a curvature. The curvature is such that the highest point is located roughly in the centre of the base wall. From this point the base wall drops away to the side walls or the transverse side walls. Thus the liquid accumulating in the interior of the tray can run off to the edges of the base wall or accumulate there. In this case the lateral areas of the base wall adjacent to the side walls and the lateral side walls must not be curved. Preferably, openings for removing the liquid to the absorbent layer are provided in the lateral areas of the base wall adjacent to the side walls and transverse walls, so that the liquids can also be removed at that point to which they have been passed due to the raised centre of the base wall. Further features of the invention will become apparent from the sub-claims.

Figure 2:
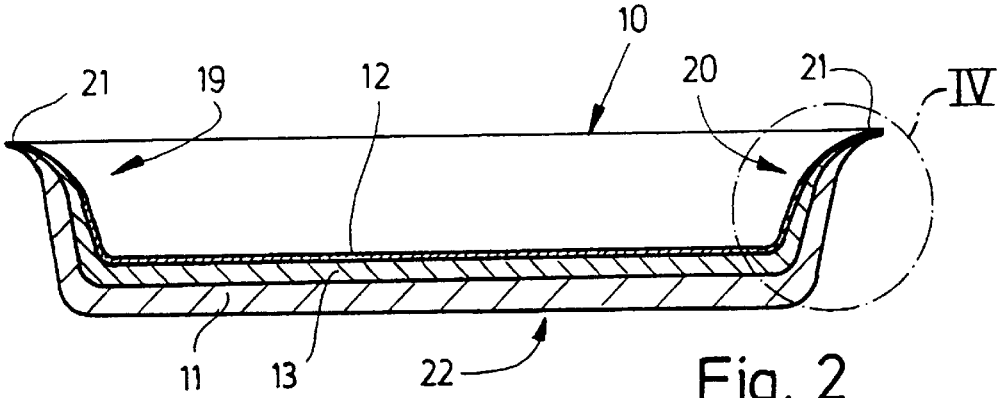
Figure 3:
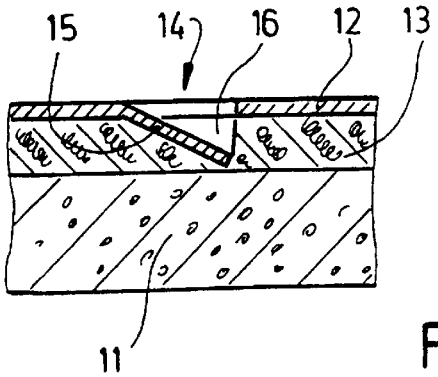
Figure 4:
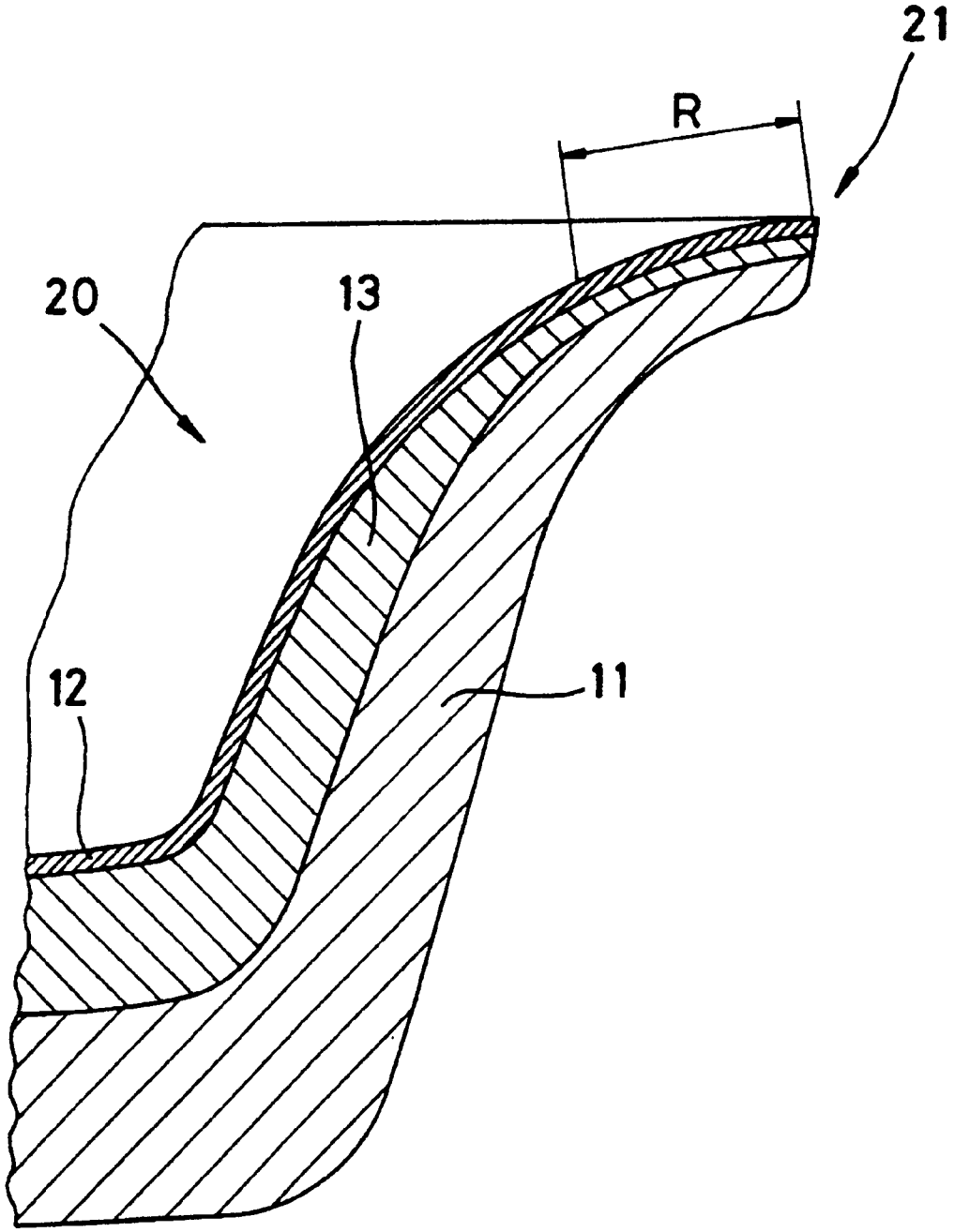
Figure 5:
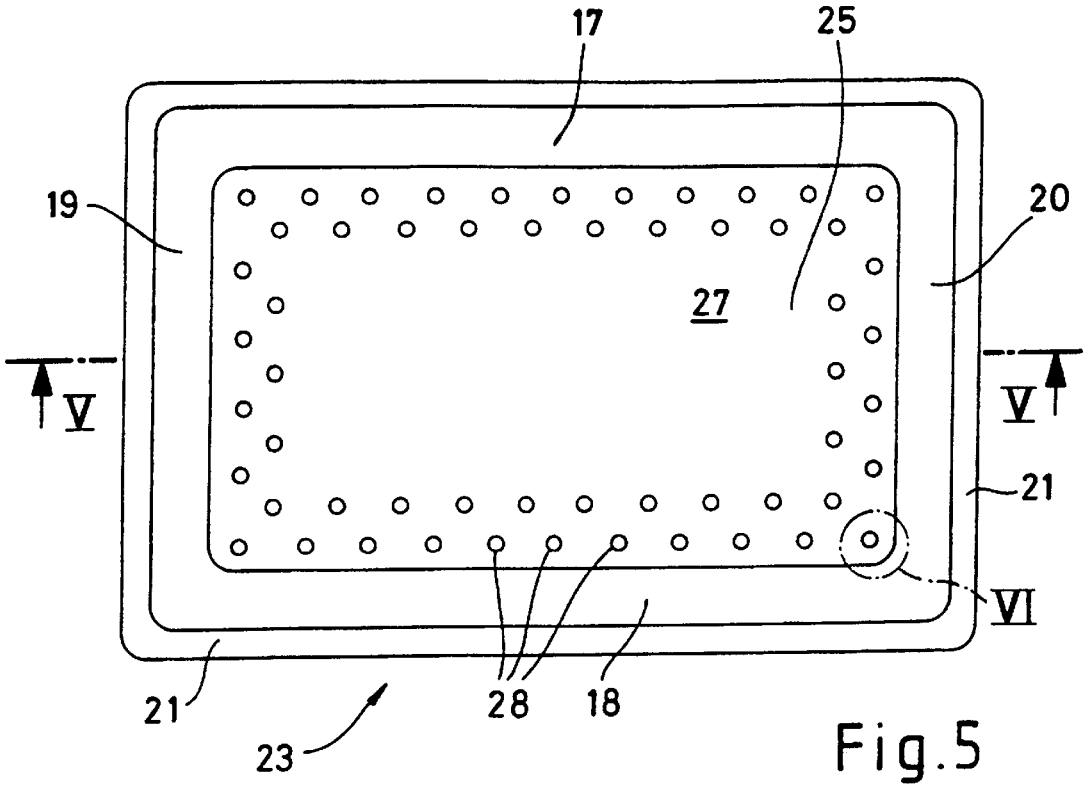
Figure 6:
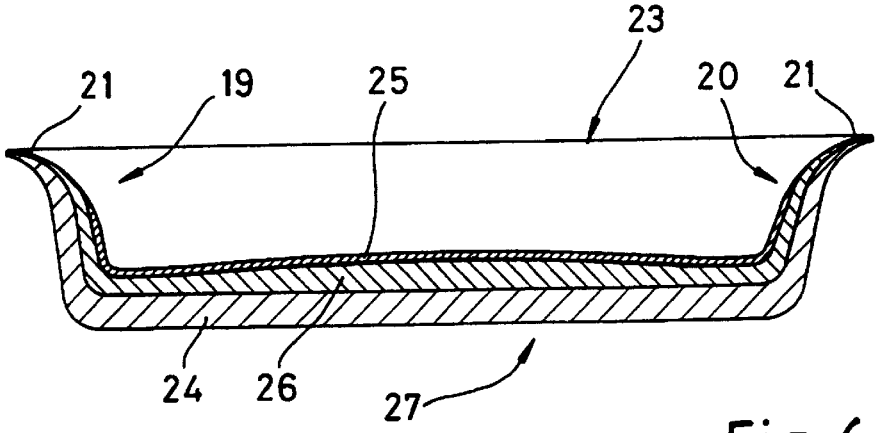
Figure 7:
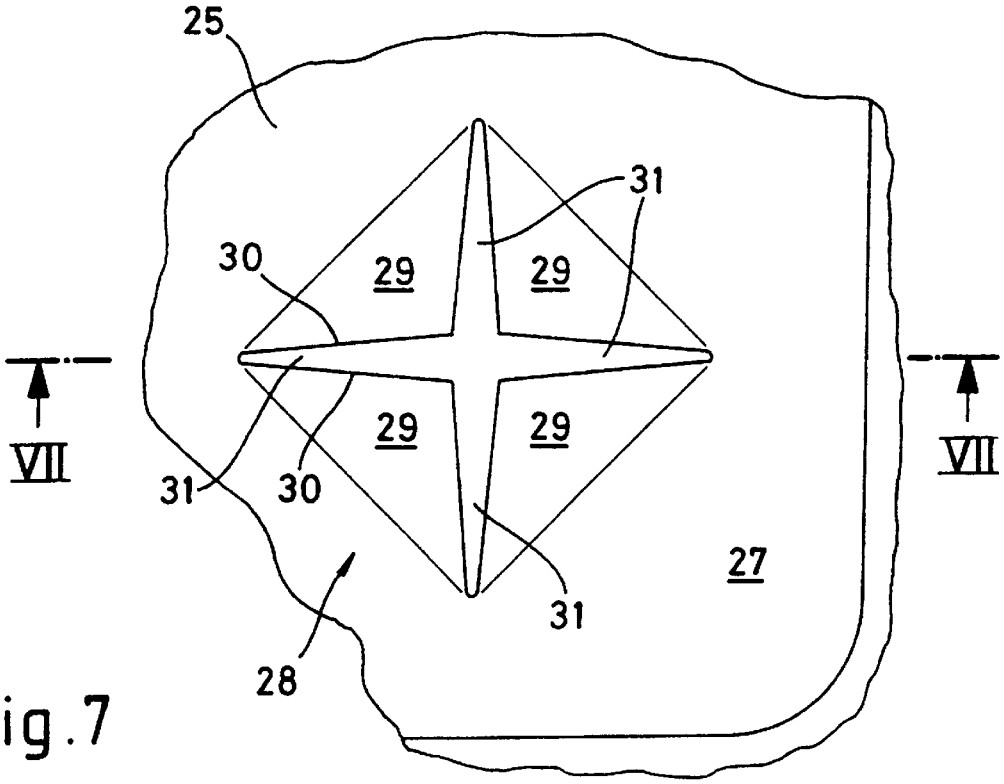
Figure 8:
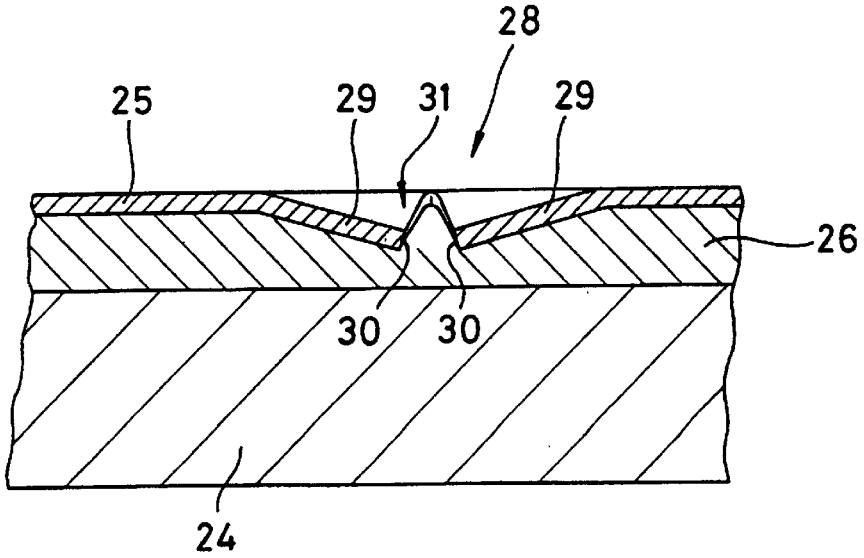

Preferred embodiments of the invention, given by way of example will be explained in more detail in the following with reference to drawings, which show:

FIG. 1: a plan view of a tray according to the invention,

FIG. 2: a cross-section of the tray along line II—II in FIG. 1,

FIG. 3: an enlarged cross-section similar to the cross-sectional view in FIG. 2, yet in the area of an opening for the passage of liquids, FIG. 4: an enlarged detail IV—IV from FIG. 2 in the area of a rim of the tray, FIG. 5: a plan view of a second embodiment of a tray according to the invention, FIG. 6: a cross-section of the tray along line V—V in FIG. 5, FIG. 7: an enlarged detail VI from FIG. 5 in the area of an opening in a base wall, FIG. 8: a cross-section through the opening in FIG. 7 along the line VII—VII.

The trays shown here are in three-layer form and are entirely made of plastic.

The tray 10 shown in FIGS. 1 to 4 has a lower ply 11 of liquid-type plastic, particularly of entirely closed-cell foam plastic, an upper ply 12 of liquid-type plastic particularly a compact, non-foamed plastic or made from a sheet, and an absorbent layer 13 located between the plies 11, 12. The outer walls of the two outer plies 11, 12 form a so-called basic tray member. The plies 11, 12, of equal size, and the layer 13, of corresponding size, are connected together substantially over their entire surface.

The absorbent layer 13 in the present case likewise consists of plastic, i.e. of an open-cell plastic, preferably an entirely open-cell foam plastic. The layer 13 is thus suitable for absorbing or taking up liquids.

The upper ply 12 has a plurality of openings 14 at regular or irregular intervals. The openings 14 can extend entirely or partly through the layer 13. FIG. 3 shows an alternative, i.e. openings 14 produced by stamping, forming an aperture tab 15, which is pressed into the layer 13 and thus forms at that point a recess 16 as a continuation of opening 14. The liquids given off by a piece of meat, fish or poultry in the tray can flow out through the openings 14 into the layer 13 and are absorbed or retained by the open cells of the layer 13.

The basic tray body of the tray 10 has in a previously known way a flat base wall 22 and obliquely upwardly aligned side walls 17, 18 and corresponding transverse side walls 19, 20. The side walls 17, 18 and transverse walls 19, 20 surround the base wall 22. Connecting with the said side walls 17, 18 and transverse walls 19, 20 in an outward direction is a surrounding rim 21. This is formed by compression of the two plies 11, 12 and of layer 13. Thus the two plies 11, 12 and the layer 13, of equal size, extend over the entire width and length of the tray 10.

The individual plies 11, 12 and the layer 13 are compressed together in the surrounding rim 21 to such an extent that the absorbent layer 13 in this area has lost its absorbent, open-celled property (FIG. 4). In this area the layer 13 is waterproof, i.e. by means of entire or partial compacting. Accordingly, no liquid can emerge out of the surrounding rim 21. In FIG. 4, the compacted region of the ply 12 and of the layer 13 has the width R. In this area R the layer 13 is compacted down to the thickness of the ply 12. Both are thus of roughly the same thickness; i.e. they have a respective thickness of about 0.4 mm. Due to the compacting of the layer 13 in the region R of the surrounding rim 21, this latter forms with the adjacent ply 12 a unified compacted plastic rim.

Finally, the surrounding rim 21 is so compressed that the lower play 11 is in fact reduced in thickness in this area, but remains flexible, being only partly compacted. In this area of reduced thickness ("R" in FIG. 4, the ply has a thickness of preferably only 1 to 2 mm. The surrounding rim 21 thus feels relatively soft, at least from below. There are no sharp edges. The described flexibility of the lower ply 11 and the compacting of layer 13 in the surrounding rim 21 may be achieved simultaneously, and do not exclude one another (FIG. 4).

In the region of the base wall 22 and in the region of the walls 17 to 20, the ply 11 has the greatest thickness. The absorbent layer 13 is slightly thinner, while the upper ply 12, due to its compact structure, is extremely thin both relative to the lower ply 11 and also to the layer 13. The lower ply 11 and the layer 13 are produced from layers of identical density and/or thickness. During manufacture of the tray 10 in a deep-drawing process with preceding heating, the lower ply 11 expands, due to the closed cells, to a greater degree than the absorbent layer 13 with open cells.

Thus the thicker lower ply 11 results relative to the layer 13.

As FIG. 1 shows, the openings 14 are provided only in the opening of the base wall 22. Corresponding openings 14 may however also be provided in the region of the side wall 17, 18 and/or of the transverse side walls 19, 20.

FIGS. 5 to 8 show a tray 23 according to a second embodiment of the invention. The tray 23 is also in a three-layer form. The tray 23, like tray 10, has a lower ply 24 of waterproof plastic, particularly of entirely closed-cell foam plastic, an upper ply 25 of waterproof plastic, particularly of a compact non-foamed plastic, for example a sheet, and an absorbent layer 26 located between the plies 24 and 25. The absorbent layer 26 also consists of a plastic, i.e. of an open-cell plastic, preferably an entirely open-celled foam plastic.

The tray 23 has a basic tray body which corresponds in form to the basic tray body of the tray 10 of FIGS. 2 to 4. In this respect reference is made to the description of tray 10, identical reference numbers identifying identical parts.

In tray 23 also, the plies 24 and 25, and the layer 26, with respect to their surface areas, are of equal size. The conditions of thickness of plies 24, 25 and of the layer 26 roughly correspond to those of the tray 10 in FIGS. 1 to 4. Also, the surrounding rim 21 of the tray 23 is waterproof, the liquid-absorbing layer 26 in the area of the surrounding rim 21 being at least compressed in such a way that its cells are closed and thus no liquids can flow outwards over the rim 21. The plies 24 and 25 are substantially connected over their entire surface with the intermediate layer 26, as is the case with the tray 10 in FIGS. 1 to 4.

In contrast to tray 10, in the tray 23 the base wall 27 is slightly curved. This curvature is such that the highest point is located roughly in the centre of the base wall 27 and from this point extends downwards both the side walls 17 and 18 and to the transverse side walls 19, 20. This inclination of the base wall 27 aligned towards the edges of the tray 23 terminates shortly before the side walls 17 and 18 and the transverse side walls 19 and 20, so that lateral areas of the base wall 27 extend roughly horizontally.

The curvature in the base wall 27 is formed by an absorbent layer 26 which is slightly curved only on the upper side. The underside of the curved layer 26 is flat (FIG. 5). The volume of this absorbent layer 26 is in this way increased. Despite the curvature of the base wall 27, the plies 24 and 25 have parallel outer walls, so that the underside of the base wall 27 of tray 23, delimited by the lower wall of the lower ply 24, is flat. The thin upper ply 25 is adapted, in the curved area of the base wall 27, to the curved configuration of the absorbent layer 26 only at the upper side of the same, so that the upper ply 25 has a curved configuration at points, and thus the base wall 27 is curved at least in the central area on the inner side of the tray 23.

It will be seen from FIG. 5 that the base wall 27 has openings 28 only on a partial area of its surface. These openings are located in lateral areas of the base wall 27 adjacent to the side walls 17 and 18 and the transverse side walls 19 and 20, i.e. preferably on such lateral areas of the base wall 27 which are not curved. In this way the openings 28 surround the curved area of the base wall 27. Accumulating liquid in the interior of the tray 23 can flow from the central highest point of the base wall 27 to the edges of the base wall 27 and the openings 28 located at that point.

In the case of the tray 23, the openings 28 are formed in a special way, i.e. by a cruciform incision. This cruciform incision extends substantially through the upper, sheet-like ply 25. Thus in the area of each opening 28, the play 25 receives four triangular tabs 29, which are pressed into the central absorbent layer 26. In this way there are provided, between edges 30 of adjacent tabs 29, intermediate spaces 31, at which the waterproof upper ply 25 does not overlap the absorbent central layer 26, so that liquids can pass through the intermediate spaces 31 to the absorbent layer 26 (FIGS. 7 and 8). By means of pressing the tabs 29 into the layer 26, there results in the area of each opening 28 a recess aligned towards the centre of the same in the base wall 27, so that the flow of liquids to each opening 28 is simplified and intensified.

It may also be envisaged to provide the tray 23 with openings 28 formed or manufactured in another way, and also to undertake the distribution of the openings on the base wall 27 and if necessary also the transverse side walls 19, 20 and/or side walls 17, 18 in a way different from that shown in FIG. 5.

Finally it may be envisaged to form the trays 10 and 23 from more than the two plies 11, 12; 24, 25 and the intermediate absorbent layer 13; 26 as shown in FIGS. 1 to 8. For example there may be provided beneath the outer side of the lower ply 11; 24 an additional (lowermost) ply, which covers the entire outer side of the lower ply 11; 24. This lowermost ply preferably consists of compact ply, for example a thin sheet similar to the upper ply 12; 25. The lowermost ply may also be coloured or carry a colour pattern or a printed message.

What is claimed is:

1. Tray for containing foodstuffs and luxury foods giving off liquids, particularly meat, fish or poultry, with a basic tray body having a base wall (22), side walls (17, 18) and transverse side walls (19, 20), and which has at least two outer plies (11, 12; 24, 25) made of waterproof plastic and an absorbent layer (13; 26) located between the plies (11, 12; 24, 25), openings (14; 28) being provided in the upper ply (12; 25) facing the foodstuffs or luxury foods, for passage of the liquids into the absorbent layer (13; 26), characterized in that the absorbent layer (13; 26) consists of an open-cell plastic and the openings (14; 28) in the upper ply (12; 25) extend into the absorbent layer (13; 26).

2. Tray according to claim 1, characterised in that the lower ply (11; 24) consists of a closed-cell foam plastic.

3. Tray according to claim 1, characterised in that the upper ply (12; 25) consists of a compact non-foamed plastic, particularly of a sheet with a thickness of preferably about 0.4 mm.

4. Tray according to claim 1, characterised in that the upper ply (12; 25) is substantially non-transparent, particularly formed from a coloured, especially dyed sheet.

5. Tray according to claim 1, characterised in that the absorbent layer (13; 26) extends as far as a surrounding rim (21).

6. Tray according to claim 5, characterised in that the two plies (11; 12, 24; 25)) are compressed together with the absorbent layer (13; 26) lying therebetween in the region of the surrounding rim (21).

7. Tray according to claim 6, characterised in that the waterproof plies (11, 12; 24,25) and the absorbent layer (13; 26) are pressed together so intensely in the area of the surrounding rim (21) in order to achieve a liquid seal, that the compressed lateral areas of the layer (13; 26) are waterproof around the periphery, and are preferably compacted with a thickness of preferably 0.4 mm.

8. Tray according to claim 6, characterised in that the two waterproof plies (11, 12; 24, 25) are pressed together with the absorbent layer (13; 26) in the area of the surrounding rim (21) in such a way that the ply (11; 24) still has, in the area of the rim (21), closed cells with a residual thickness of preferably 1 to 2 mm.

9. Tray according to claim 5, characterised in that the two plies (11, 12; 24, 25) are substantially connected over their entire surface to the absorbent layer (13; 26) lying therebetween.

10. Tray according to claim 1, characterised in that at least the base wall (27) is at least partly curved, in such a way that it extends in a downwards alignment to the side walls (17, 18) and/or the transverse side walls (19, 20).

11. Tray according to claim 10, characterised in that at least a part of the opening (28) is located in the areas of the curved base wall (22) that extend in a downward alignment.

12. Tray according to claim 1, characterised in that it has on the outer side of the lower ply (11; 24) an additional outer ply of a compact non-foamed plastic, particularly a sheet.

13. Tray according to claim 12, characterised in that the ply (11; 24) of closed-cell foam plastic and the absorbent layer (13; 26) of open-cell foam plastic are located between the two plies forming the two oppositely-situated outer sides.

* * * * *